US005669760A

United States Patent [19]

Chen

[11] Patent Number: 5,669,760

[45] Date of Patent: Sep. 23, 1997

[54] CEILING FAN WITH INTEGRAL BLADE AND NECK

[76] Inventor: Jung-San Chen, No. 1, Section 2, Da-Feng Rd., Da-Feng Village, Tan Tze Hsiang, Taichung Hsien, Taiwan

[21] Appl. No.: 679,340

[22] Filed: Jul. 11, 1996

[51] Int. Cl.[6] ..... F04D 29/34; F04D 29/38

[52] U.S. Cl. ..... 416/210 R; 416/5; 416/237

[58] Field of Search ..... 416/5, 170 R, 416/210 R, 214 R, 228, 234, 243, 244 R, 235, 237; D23/377, 379, 411, 413, 385

[56] References Cited

U.S. PATENT DOCUMENTS 4,028,007 6/1977 Cavagnero et al. ..... 416/214 R
4,135,857 1/1979 Pannone et al. ..... 416/234
4,592,702 6/1986 Bogage ..... 416/5
4,850,799 7/1989 Bucher, Sr. et al. ..... 416/5
5,554,006 9/1996 Liao ..... 416/235

*Primary Examiner*—Christopher Verdier
*Attorney, Agent, or Firm*—Bacon & Thomas

[57] ABSTRACT

A combination of a blade and a support of a ceiling fan includes a blade portion and a support portion, the blade portion being an elongate plate which has one end to be a free end, the support portion including a base and a neck which extends from the base and integrally connects to the other end of the blade portion, the blade portion having a curved surface defined in an under surface thereof along a longitudinal axis of the blade portion, the blade portion having two upper longitudinal edges and two lower longitudinal edges, each of the two upper longitudinal edges and the lower longitudinal edges being shaped to have an inclined surface so as to reduce resistance of air.

2 Claims, 4 Drawing Sheets

CEILING FAN WITH INTEGRAL BLADE AND NECK

BACKGROUND OF THE INVENTION

1. Field of the Invention

The present invention relates to a combination of a blade and a support of a ceiling fan and more particularly, to a support integrally connected to a blade which has a curved surface defined in an under side thereof and the blade has an inclined surface defined along each of the longitudinal edges thereof.

2. Brief Description of the Prior Art

FIGS. 1 and 2 show a conventional ceiling fan which includes at least three blades 10 (only two blades are shown in FIG. 1), each of the three blades 10 has one end thereof connected to a support 20 and the support 20 is connected to a motor 30 drives the supports 20 and the blades 10 to rotate about an axis of the motor 30. The blade 10 has three first holes 11 defined therethrough and the support 20 has one end with three second holes 211 defined therein so as to have a bolt 12 extending through each one of the second holes 211 and the first holes 11 in alignment with each other and engaging with a nut 13 to securely connect the support 20 and the blade 10. The other end of the support 20 has two third holes 23 defined therethrough so as to connect to the motor 30. However, such a design has the following shortcomings:

(1) The manufacturing cost of the support 20 and the blade 10 are high because they have to be manufactured separately and each of them need to be machined to have holes therein.

(2) When assembling the support 20 and the blade 10, the blade 10 is difficult to achieve a desired angle corresponding to a horizontal plane because the first holes 11 and the second holes 211 could be machined with slight inaccuracy which results in an inaccurate connection, and every time a combiner screws the bolts 12, he/she has to exert a desired torque otherwise the inclined angle of the blade will be changed.

(3) Generally, the support 20 is made of metal which is too heavy for the motor 30.

(4) The connection between the blade 10 and the support 20 by bolts 12 and nuts 13 could be loosened after a period of time of operation of the ceiling fan and noise will be produced.

The present invention intends to provide a combination of the support and the blade which has a curved surface defined in an under surface thereof and an inclined surface defined in each of the longitudinal edges of the blade so as to mitigate and/or obviate the above-mentioned problems.

SUMMARY OF THE INVENTION

The present invention provides a combination of a blade and a support of a ceiling fan and includes a blade portion and a support portion, the blade portion being an elongate plate which has one end to be a free end, the support portion comprising a base and a neck which extends from the base and integrally connects to the other end of the blade portion. The blade portion has a curved surface defined in an under surface thereof along a longitudinal axis of the blade portion.

It is an object of the present invention to provide an integral combination of a blade and a support of a ceiling fan.

It is another object of the present invention to provide a combination of the support and the blade which has a curved surface defined in an under surface thereof.

It is a further object of the present invention to provide a combination of the support and the blade which has an inclined surface defined in each of four longitudinal edges thereof.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
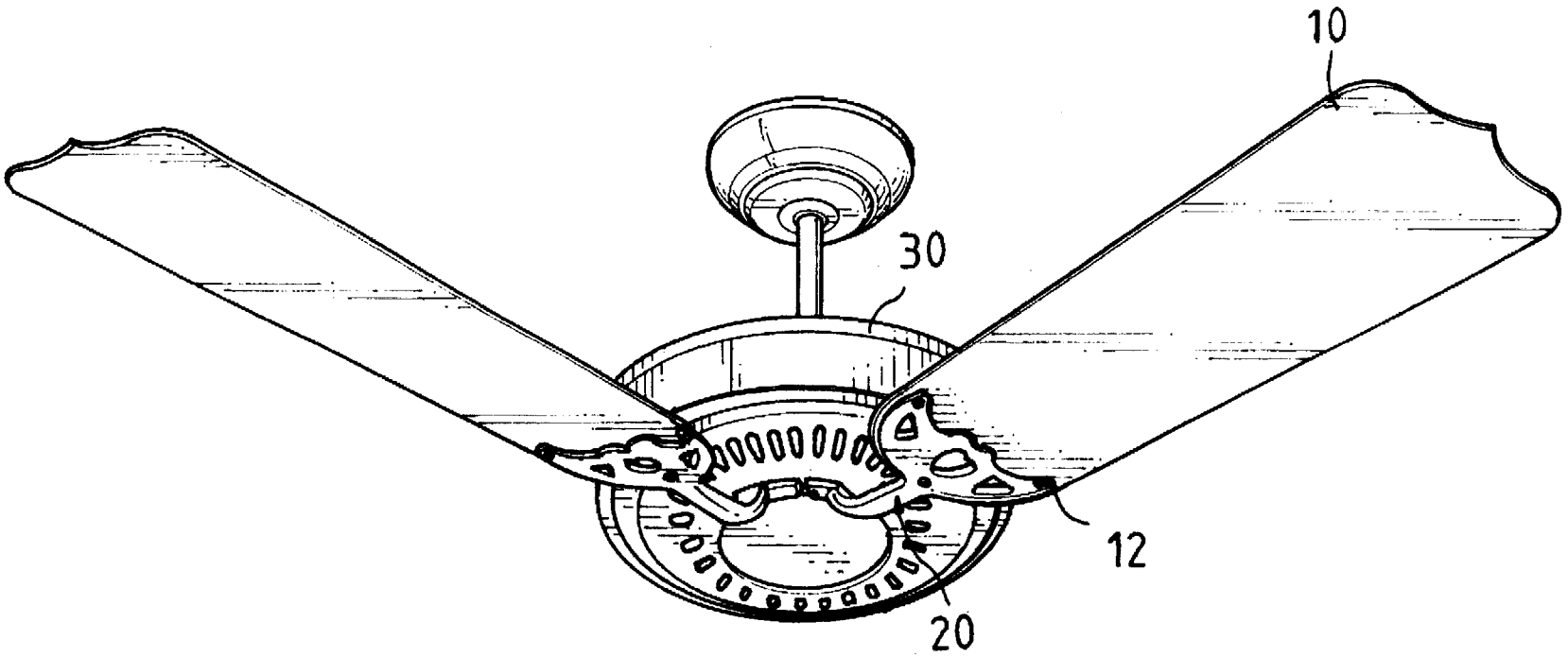
FIG. 1 PRIOR ART
FIG. 1 is a perspective view of a conventional ceiling fan wherein only two blades are shown.
Figure 2:
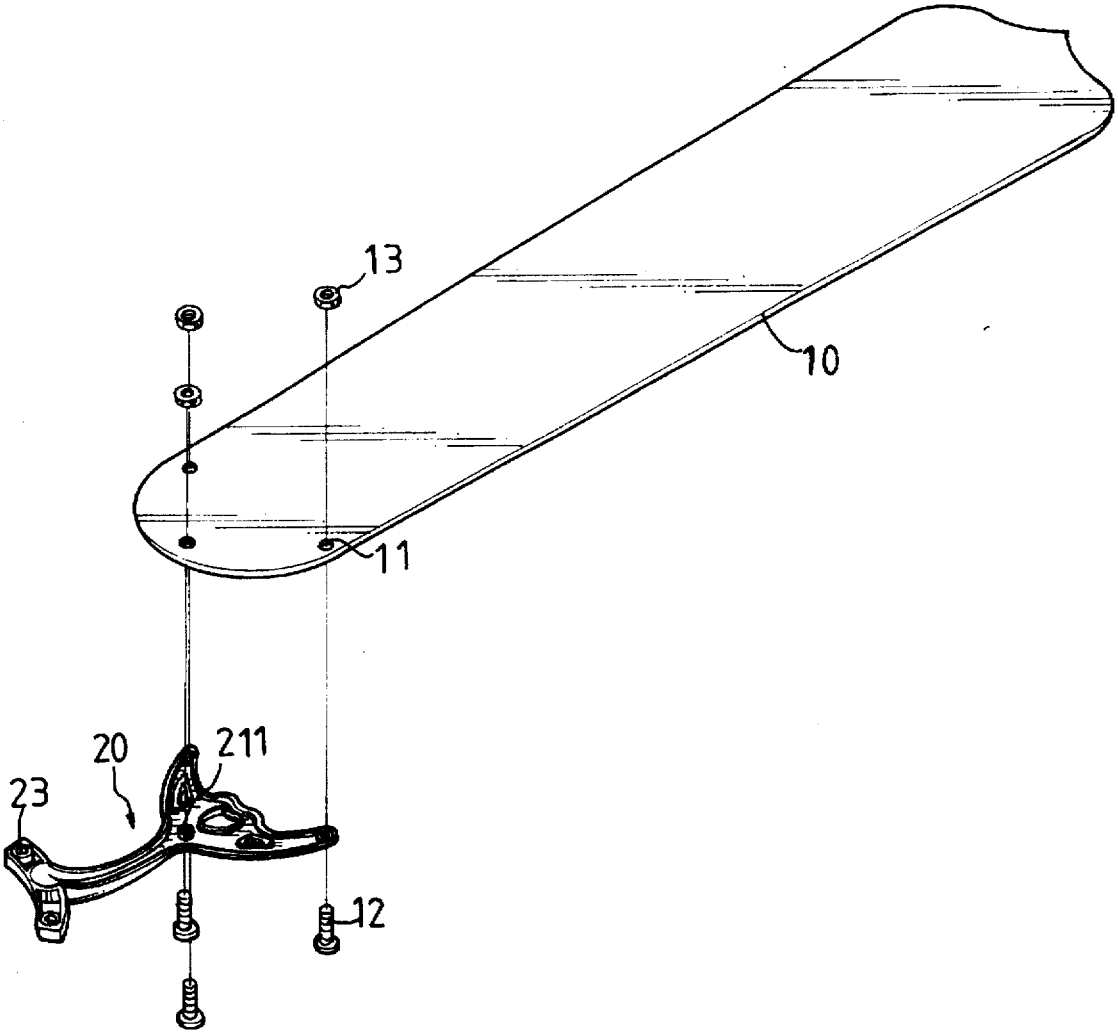
FIG. 2 PRIOR ART
FIG. 2 is an exploded view of the conventional blade and a conventional support.
Figure 3:
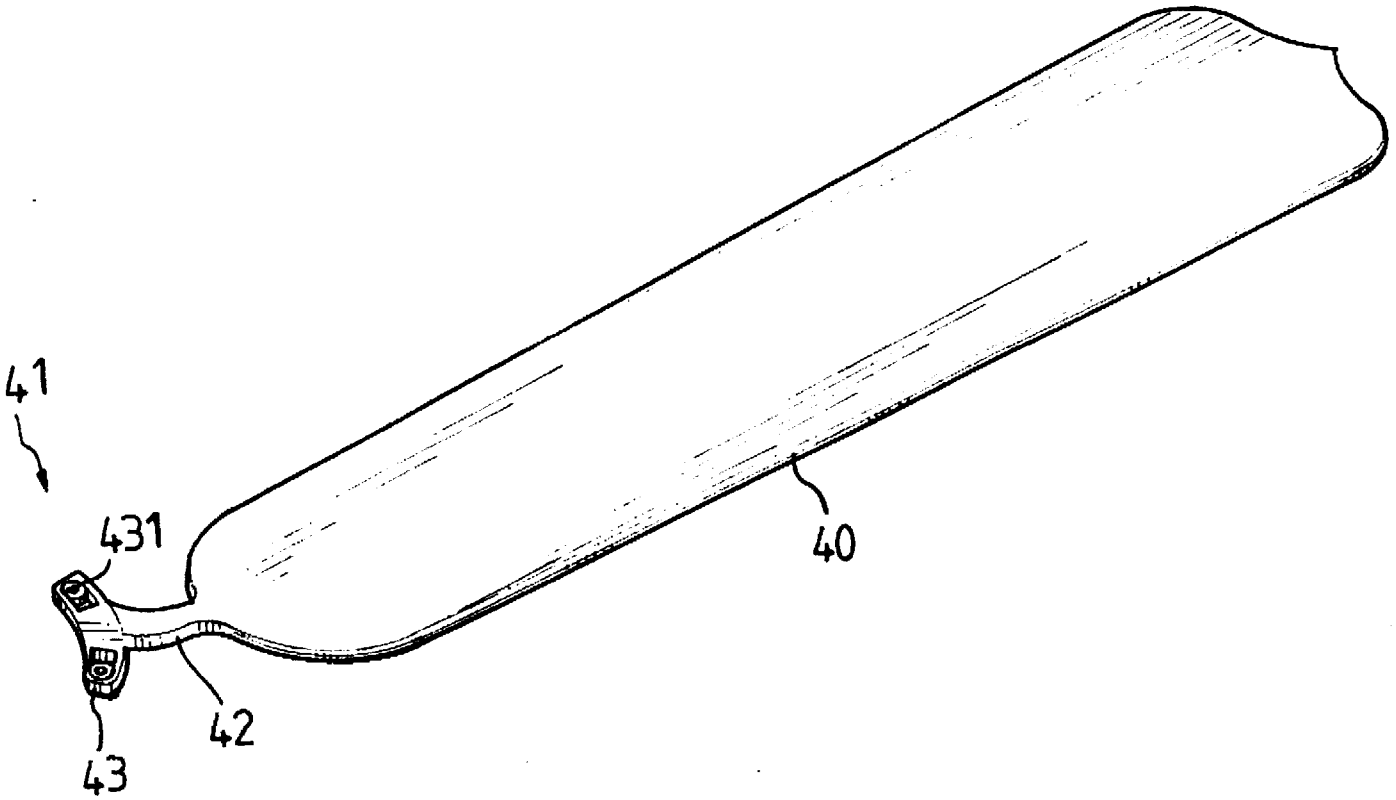
FIG. 3 is a perspective view of a combination of a blade and a support in accordance with the present invention.
Figure 4:
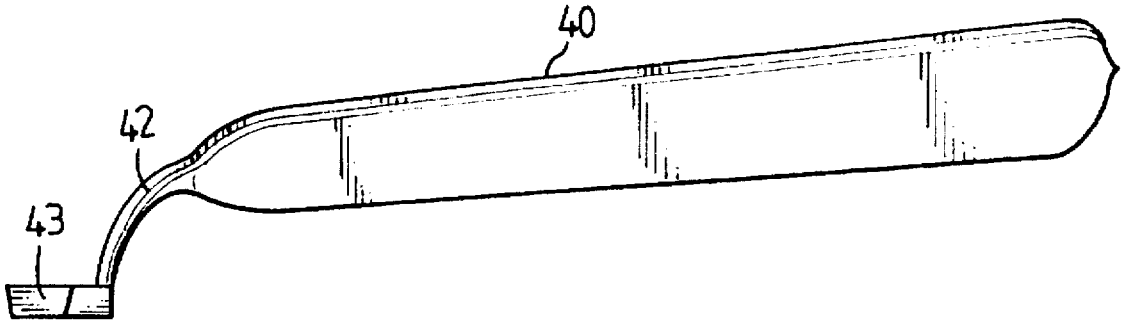
FIG. 4 is a side elevational view of the combination of the blade and the support in accordance with the present invention.
Figure 5:
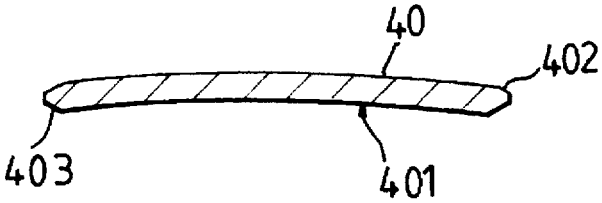
FIG. 5 is an end cross-sectional view of the blade portion of the combination.

Referring to the drawings and initially to FIGS. 3 through 5, a combination of a blade and a support of a ceiling fan in accordance with the present invention generally includes a blade portion 40 and a support portion 41. The blade portion 40 is an elongate plate which has one end to be a free end. The support portion 41 comprises a base 43 and a neck 42 which extends from the base 43 and integrally connects to the other end of the blade portion 40. The blade portion 40 has a curved surface 401 defined in an under surface thereof along a longitudinal axis of the blade portion 40. The base 43 has two holes 431 defined therethrough so as to connect to a motor (not shown).

The blade portion 40 has two longitudinal sides each have an upper longitudinal edge and a lower longitudinal edge, each of the two upper longitudinal edges and the lower longitudinal edges being shaped to have an inclined longitudinal surface 402/403 so as to form each of the two sides to be a wedge-like side to reduce resistance of air.

Figure 6:
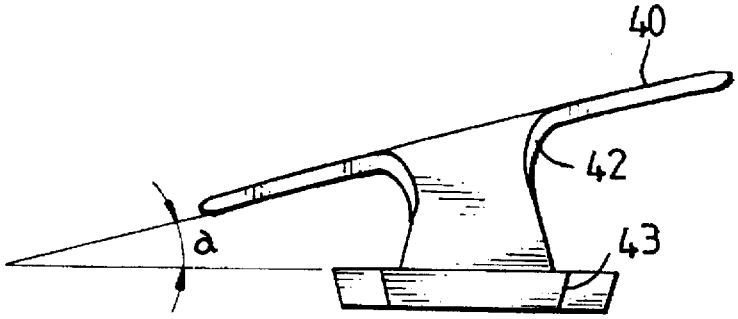
FIG. 6 is an end elevational view of the combination.

Referring to FIG. 6, the relative angle a between the base 43 and the blade portion 40 is determined similar to the conventional design so as to produce air flow when the blade portion 40 is rotated.

Accordingly, the present invention has the following advantages:

(1) The support portion 41 and the blade portion 40 are manufactured integrally such that the angle a is easily set.

(2) The combination is made by ABS such that the total weight thereof is reduced and therefore the motor produces a desired efficiency.

(3) The blade portion 40 has the curved surface 401 and the wedge-like sides will remarkably reduce resistance of air.

(4) Noise will be reduced because there are no bolts and nuts on the combination.

Although the invention has been explained in relation to its preferred embodiment, it is to be understood that many other possible modifications and variations can be made without departing from the spirit and scope of the invention as hereinafter claimed.

What is claimed is:

1. A combination of a blade portion and a blade support portion of a ceiling fan, said blade portion being an elongate plate which has one end which is a free end, said support portion comprising a base and a neck which extends from said base and integrally connects to the other end of said blade portion; and said blade portion having a curved surface defined in an under surface thereof along a longitudinal axis of said blade portion, and two longitudinal sides each having an upper longitudinal edge and a lower longitudinal edge, each of said two upper longitudinal edges and said lower longitudinal edges being shaped to have an inclined longitudinal surface so as to form each of said two sides as a wedge-like side to reduce resistance of air.

2. The combination as claimed in claim 1 wherein said base has at least two holes defined therein.

* * * * *